United States Patent [19]

D'Heureuse et al.

[11] Patent Number: 4,991,505

[45] Date of Patent: Feb. 12, 1991

[54] DEVICE FOR PERFORMING A CIRCUMFERENTIAL-REGISTER ADJUSTMENT IN A SHEET-FED ROTARY PRINTING PRESS

[75] Inventors: Walter D'Heureuse, Ladenburg; Martin Greive, Leimen, both of Fed. Rep. of Germany

[73] Assignee: Heidelberger Druckmaschinen AG, Heidelberg, Fed. Rep. of Germany

[21] Appl. No.: 482,529

[22] Filed: Feb. 21, 1990

[30] Foreign Application Priority Data

Feb. 21, 1989 [DE] Fed. Rep. of Germany ..... 3905250

[51] Int. Cl.[5] ..... B41F 13/14

[52] U.S. Cl. ..... 101/248; 101/216; 101/247

[58] Field of Search ..... 101/137, 139, 140, 144, 101/145, 209, 218, 247, 248, 212, 216, 217; 33/614, 620

[56] References Cited

U.S. PATENT DOCUMENTS 2,024,813 12/1935 Barber ..... 101/177
3,098,434 7/1963 Lime ..... 101/248
4,004,509 1/1977 Moss ..... 101/248
4,573,408 3/1986 Bezler et al. ..... 101/248

FOREIGN PATENT DOCUMENTS 2264285 7/1974 Fed. Rep. of Germany .

*Primary Examiner*—David A. Wiecking
*Assistant Examiner*—Ren Yan
*Attorney, Agent, or Firm*—Herbert L. Lerner; Laurence A. Greenberg

[57] ABSTRACT

A device for performing a circumferential-register adjustment in a sheet-fed rotary printing press with a printing unit including an impression cylinder, a blanket cylinder and at least one plate cylinder engageable with the blanket cylinder and drivable by the impression cylinder via an intermediate gearwheel, comprising a mounting movable with respect to the machine frame, the one plate cylinder being held in the mounting together with the intermediate gearwheel as well as with inking and dampening units assigned to the plate cylinder, the mounting being held in the machine frame so as to be swivellable about an axis disposed parallel to axes of the cylinders of the printing unit and lying at a point of intersection of a straight connecting line through the axes of the impression cylinder and the intermediate gearwheel.

5 Claims, 1 Drawing Sheet

DEVICE FOR PERFORMING A CIRCUMFERENTIAL-REGISTER ADJUSTMENT IN A SHEET-FED ROTARY PRINTING PRESS

The invention relates to a device for performing a circumferential-register adjustment in a sheet-fed rotary printing press.

BACKGROUND

A plate cylinder and a blanket cylinder are adjusted in phase relationship thereof by the adjustment of the circumferential register. This adjustment thus effects a relative movement between the printing plate of the plate cylinder and the sheet in or opposite to the sheet travel direction.

Costly differential transmissions or gear units, such as planetary gear units or axially displaceable gearwheels with helical gearing, have become known heretofore for this purpose, in order to enable adjustment while the machine is running, yet only within a relatively small range.

In the case of smaller machines, gear drives with at least two intermediate gearwheels are known, above all, the two gearwheels being displaceable together with their bearings, thereby permitting a circumferential-register adjustment to be made. In constructions of this kind, the bearings of the intermediate gearwheels are correspondingly unstable. It is also possible for a circumferential-register setting to be made by adjusting the front lays, if the run or travel of the paper enables this. The most cost-effective and conventional adjustment device employs gearwheels rotatable in phase relationship thereof with respect to the cylinder, which must be released for the adjustment and locked again after the adjustment. Such devices for circumferential-register adjustment are able to operate only when the machine is stopped. Readjustments thus require adequately frequent stopping and restarting of the machine which demands a relatively large expenditure of time, and occasions much waste formation.

The foregoing details regarding the prior art correspond to the practical construction of conventional or marketable machines.

A construction which is especially problematic is that of a circumferential-register adjustment device in printing units for the printing of an additional color, so-called satellite printing units, which are removably or swivellably fastened to the frame of a sheet-fed rotary printing press and are brought into an operating position only when required. In satellite printing units, the components for circumferential-register adjustment contribute significantly to the undesired increase in the weight of such a printing unit and, in so doing, also raise its level of instability.

SUMMARY OF THE INVENTION

It is, accordingly, an object of the invention to provide, with a high standard of precision, an especially simple and stable means for performing a circumferential-register adjustment while the machine is running.

With the foregoing and other objects in view, there is provided, in accordance with the invention, a device for performing a circumferential-register adjustment in a sheet-fed rotary printing press with a printing unit including an impression cylinder, a blanket cylinder and at least one plate cylinder engageable with the blanket cylinder and drivable by the impression cylinder via an intermediate gearwheel, comprising a mounting movable with respect to the machine frame, the one plate cylinder being held in the mounting together with the intermediate gearwheel as well as with inking and dampening units assigned to the plate cylinder, the mounting being held in the machine frame so as to be swivellable about an axis disposed parallel to axes of the cylinders of the printing unit and lying at a point of intersection of a straight connecting line through the axes of the impression cylinder and the intermediate gearwheel.

A swivel movement of the plate cylinder and of the intermediate gearwheel about an axis lying at the point of intersection of the straight connecting line through the axes of the plate cylinder and of the blanket cylinder, with the straight connecting line through the axes of the intermediate gearwheel and of the impression cylinder, produces a relative movement of the outer cylindrical surface of the plate cylinder with respect to the outer cylindrical surface of the blanket cylinder, a rolling movement of the two cylinders on one another being prevented by the meshing of the intermediate gearwheel with the plate cylinder In this regard, there is an extensively minimized variation in the contact pressure between the blanket cylinder and the plate cylinder, if there is a clockwise or counterclockwise swing or swivel out of the position of maximum contact pressure. The reduction in the contact pressure in this regard is so slight that it may be ignored.

The circumferential-register adjustment comprises, as a first part, the swivel movement of the plate cylinder and, additionally, a rotation by the drive gearwheel in the same direction. This rotation is a result of the meshing of the intermediate gearwheel with the impression cylinder. A circumferential-register adjustment of adequate extent, for example within a range of about 5 mm, can thus be performed by a very small swivel movement.

A considerable advantage of a construction having the features according t the invention is that the swivelling of the mounting for the purpose of circumferential-register adjustment can be performed while the machine is in operation, so that the machine does not have to be stopped in order to adjust the circumferential register.

In accordance with another embodiment of the invention, a device for performing a circumferential-register adjustment in a sheet-fed rotary printing press having a main printing unit including an impression cylinder, a blanket cylinder and a plate cylinder engageable with the blanket cylinder, and a satellite printing unit with a plate cylinder driven by the impression cylinder of the main printing unit via an intermediate gearwheel, comprises means for holding the satellite printing unit in the machine frame so as to be swivellable about an axis, the axis lying at a point of intersection of a first straight connecting line through an axis of the plate cylinder of the satellite printing unit and an axis of the blanket cylinder, with a second straight connecting line through an axis of the intermediate gearwheel and an axis of the impression cylinder. In order to realize the features according to the invention, the mounting of the satellite printing unit is held on a swivel axis, which lies at the point of intersection of the aforementioned axes and, moreover, is supported in a horizontally sliding manner, this support, however, being adjustable in height in order to perform the aforementioned swivel movement. A spindle drive, an eccentric or the like, are suitable as the extremely simplest machine part for accomplishing such a height adjustment; however, it is also possible to provide other, in particular, motor-driven means for effecting such a height adjustment, such as motordriven or motive means, in particular.

According to an additional development of the invention, the device for circumferential-register adjustment in an embodiment on a satellite printing unit is constructed simultaneously for adjusting the contact pressure between the plate cylinder of the satellite printing unit and the blanket cylinder of the main printing unit. In order to achieve this purpose and, in accordance with a concomitant feature of the invention, the center of rotation of the mounting of the satellite printing unit is displaceably disposed on the bisector of the angle between the two straight connecting lines as defined further hereinabove. This displacement can likewise be performed while the machine is in operation.

With the displacement of the swivel bearing on an angle bisector, for example in order to reduce the contact pressure, the intermediate gearwheel performs a slight rotation, turning the plate cylinder of the satellite printing unit in a counterclockwise direction. Upon such displacement, a point on the outer cylindrical surface of the plate cylinder moves in a clockwise direction in relation to the blanket cylinder. The resulting rotations are of equal magnitude and thus cancel one another out.

Other features which are considered as characteristic for the invention are set forth in the appended claims.

Although the invention is illustrated and described herein as embodied in a device for performing a circumferential-register adjustment in a sheet-fed rotary printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DETAILED DESCRIPTION OF THE INVENTION

Figure 1:
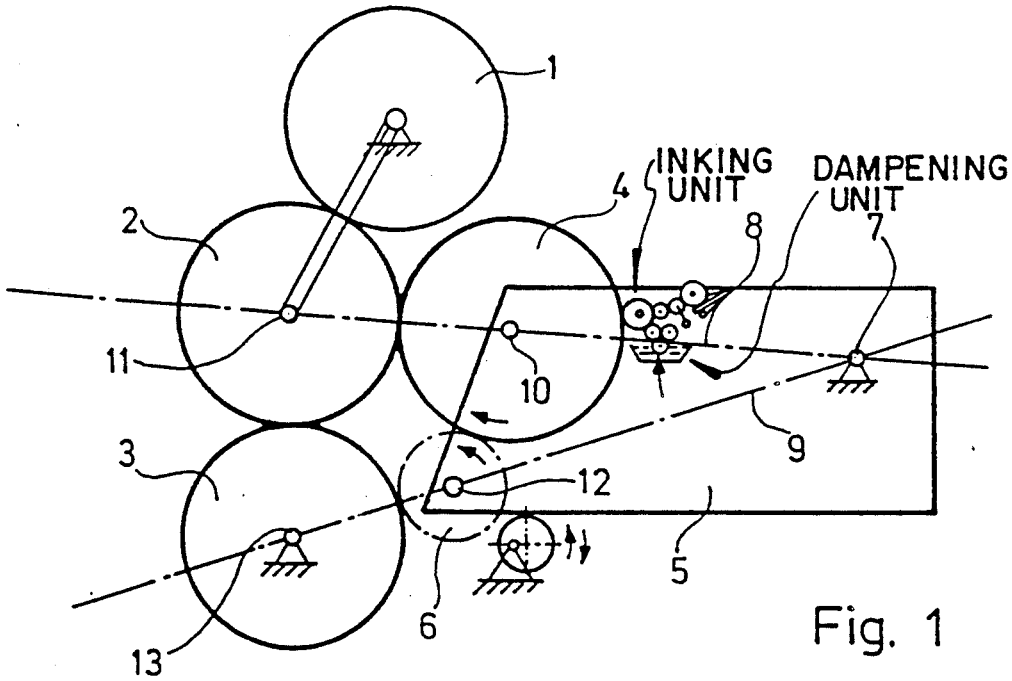
FIG. 1 is a diagrammatic side elevational view of an arrangement of a satellite printing unit with the device for performing circumferential-register adjustment in accordance with the invention.
Figure 2:
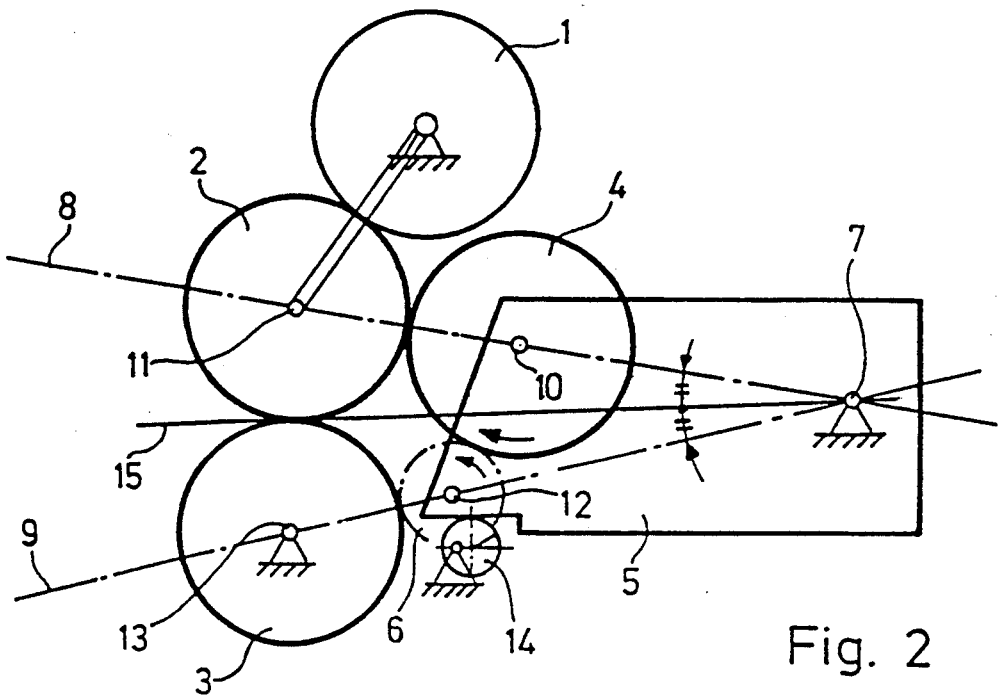
FIG. 2 is a view like that of FIG. 1 of another embodiment of the device having features for adjusting contact pressure.

Referring now to the figures of the drawing, there is shown therein, in a highly simplified representation, only a plate cylinder 1, a blanket or rubber-covered cylinder 2 and an impression cylinder 3 of a printing unit. In the interest of greater clarity, the drawing does not show the mechanically interengaging drive members of the cylinders 1, 2 and 3 of the printing unit. A plate cylinder 4 of a satellite printing unit is held in a mounting or frame 5 or the like and is driven by an intermediate gearwheel 6 having teeth meshing, on the one hand, with teeth on the impression cylinder 3 and, on the other hand, with teeth on the plate cylinder 4 of the satellite printing unit. This intermediate gearwheel 6 is also rotatably held in the mounting 5. The mounting 5 is, in turn, disposed so as to be swivellable about an axis 7, for example about a pin, the axis 7 lying at a point of intersection of straight connecting lines 8 and 9. The connecting line 8 extends through an axis of the plate cylinder 4 of the satellite printing unit and through an axis 11 of the blanket or rubber-covered cylinder 2, the connecting line 9 passing through an axis 12 of the intermediate gearwheel 6 and through an axis 13 of the impression cylinder 3. The mounting 5 is supported, moreover, on a counterbearing 14, which is adjustable in height and, in the case of both of the specific embodiments of FIGS. 1 and 2, is in the form of a rotatable eccentric 14 in a bearing fixed to the machine. By rotation of the eccentric in one or the other direction, a swivel movement of the mounting 5 about the swivel axis 7 can be achieved in order to perform a circumferential-register adjustment of the plate cylinder 4 with respect to the blanket or rubber-covered cylinder 2.

According to the specific embodiment cf FIG. 2, the swivel bearing of the mounting 5 is linearly adjustable with the axis 7, the movement associated therewith being performed on an angle bisector 15 between the two straight connecting lines 8 and 9. Such a construction permits the aforedescribed adjustment of the contact pressure between the plate cylinder 4 and the blanket or rubber-covered cylinder 2, due to which a mutual cancellation of the influences of this adjustment movement on the circumferential-register adjustment is achieved. The slight rotating movement of the intermediate gearwheel 6, which occurs when the mounting 5 is displaced on the angle bisector 15 does, in fact, result in a rotating movement of the plate cylinder 4, however, when such a displacement occurs, a point on the outer cylindrical surface of the plate cylinder 4 travels in the opposite direction relative to the blanket or rubber-covered cylinder 2, so that the two movements cancel one another out.

The foregoing is a description corresponding in substance to German Application P 39 05 250.8, dated Feb. 21, 1989, the International priority of which is being claimed for the instant application, and which is hereby made part of this application. Any material discrepancies between the foregoing specification and the aforementioned corresponding German application are to be resolved in favor of the latter.

We claim:

1. Device for performing a circumferential-register adjustment in a sheet-fed rotary printing press having a machine frame with a printing unit including an impression cylinder an intermediate gear wheel, a blanket cylinder and at least two plate cylinders engageable with the blanket cylinder, one of said plate cylinder being drivable by the impression cylinder via said intermediate gearwheel, comprising a mounting movable with respect to the machine frame, one of said plate cylinders being held in said mounting together with the intermediate gearwheel inking and dampening units assigned to said one of said plate cylinders and carried by said mounting, said mounting being held in the machine frame so as to be pivotal about an axis disposed parallel to axes of the cylinders of the printing unit and lying on of a straight connecting line through the axes of the impression cylinder and the intermediate gearwheel.

2. Assembly for performing a circumferential-register adjustment in a sheet-fed rotary printing press, comprising a machine frame and a main printing unit including an impression cylinder, a blanket cylinder and a first plate cylinder engageable with the blanket cylinder, and a satellite printing unit pivotably mounted about an axis and having an intermediate gear wheel and a second plate cylinder driven by the impression cylinder of the main printing unit via the intermediate gearwheel, said axis lying at a point of intersection of two straight lines including a first straight line through the axis of the second plate cylinder of the satellite printing unit and axis of the blanket cylinder, and a second straight line through the axis of the intermediate gearwheel and the axis of the impression cylinder.

3. Device according to claim 1, wherein said mounting, at one end, is held in a pivotal bearing and, at the other end, is slidingly movably supported on a rotatable eccentric mounted on the machine frame.

4. Assembly according to claim 2, including means for holding the satellite printing unit comprising a mounting held at one end in a pivotal bearing and slidingly movably supported, at the other end, on a rotatable eccentric mounted on the machine frame.

5. Assembly according to claim 4, wherein said mounting has a center of rotation displaceable on a bisector of an angle defined by the intersecting first and second straight connecting lines.

* * * * *